US005138967A

United States Patent [19]

McCarron et al.

[11] Patent Number: 5,138,967

[45] Date of Patent: Aug. 18, 1992

[54] MARINE ANCHOR

[75] Inventors: Philip F. McCarron; James W. Stewart; Gordon M. Lyall, all of Glasgow, Scotland

[73] Assignee: Simpson-Lawrence Ltd., Glasgow, Scotland

[21] Appl. No.: 582,939

[22] PCT Filed: Apr. 3, 1989

[86] PCT No.: PCT/GB89/00339

§ 371 Date: Nov. 1, 1990

§ 102(e) Date: Nov. 1, 1990

[87] PCT Pub. No.: WO89/09722

PCT Pub. Date: Oct. 19, 1989

[30] Foreign Application Priority Data

Apr. 9, 1988 [GB] United Kingdom ..... 8808373

[51] Int. Cl.[5] ..... B63B 21/40

[52] U.S. Cl. ..... 114/301

[58] Field of Search ..... 114/294, 295, 297, 301, 114/302, 303, 304, 305, 306, 307, 308, 309, 310

[56] References Cited

U.S. PATENT DOCUMENTS 1,983,481 12/1934 Mortensen ..... 114/301
2,161,906 6/1939 Filby ..... 114/301
2,948,249 8/1960 Gesner et al. .
3,759,212 9/1973 Cluett ..... 114/309
4,602,588 7/1986 MacLean ..... 114/301

FOREIGN PATENT DOCUMENTS 225678 8/1985 Fed. Rep. of Germany ..... 114/301
7710882 4/1978 Netherlands .
415176 8/1934 United Kingdom .

OTHER PUBLICATIONS

Whitworth's Nautical World, 1979 Export & Mail Order Catalogue; p. 41; Anchors Fenders and Oars.

*Primary Examiner*—Jesus D. Sotelo
*Assistant Examiner*—Stephen P. Avila
*Attorney, Agent, or Firm*—Pennie & Edmonds

[57] ABSTRACT

A marine anchor is described which has a shank having a leading end for attachment to a cable and a general double-bladed ploughshare shaped fluke fixed to the shank with the blades disposed symmetrically about the median plane of the shank. The leading ends of the blades terminate in a single apex and the trailing ends of each blade diverges outwardly from said medial plane, each blade having a generally inwardly dished shape. The blades can be curved or consist of at least two flat angled surfaces.

15 Claims, 5 Drawing Sheets

MARINE ANCHOR

This invention relates to anchors of the burying type and in particular to those of the C.Q.R. type.

Over the years a number of different forms of the so called burying type of anchor have been developed. The shape and form of these is generally designed so that as the anchor is dragged along a mooring bed at the bottom or a body of water, e.g. the sea bed, the flukes tend to bury themselves into the mooring bed. Various attempts have been made with greater or less degrees of success to produce a shape and configuration such that whatever the attitude of the anchor as it lands on the mooring bed, as it is dragged along the mooring body it automatically assumes the correct upright attitude for burying itself into the mooring bed.

A major problem that remains, however, is that when dragging of the turned anchor is continued it tends to "roll out" i.e. the anchor tends to continue to roll about an axis generally parallel to the direction of drag until the flukes emerge from the mooring bed whereupon the anchoring resistance is substantially lost. Some anchors of the burying type are also difficult or awkward to manufacture and/or handle. To achieve penetration existing anchors are usually pivotable or hinged about a point of the shank of the anchor. This results in anchors which are non-rigid and this can be dangerous when lifting of the anchor is required.

It is an object of the present invention to provide an anchor which obviates or mitigates at least one of the aforesaid disadvantages.

According to the present invention there is provided a one-piece anchor comprising a shank having a leading end adapted to be connected to a main anchor cable, a fluke rigidly fixed to the shank, said fluke generally being in the shape of a double-bladed ploughshare with the blades being disposed symmetrically about the median plane of the shank, the leading ends of the blades terminating in a single apex, the trailing ends of each blade diverging outwardly from said medial plane, and each blade having a generally inwardly dished shape said shank and fluke being arranged to define a buoyant center of gravity disposed between the shank and the fluke forwardly of the join of the shank and the fluke.

Preferably said buoyant center of gravity is disposed on the fluke side of a line drawn between the leading end of the shank and a line of maximum blade width. Preferably also said buoyant center of gravity being arranged so that the anchor, in use, lands on the seabed with a three-point contact, said three-point contact being provided by the leading end of the shank, said common apex and the trailing end of one of the blades Conveniently the blades are curved metal sheets. Conveniently the blades are welded together at a join on said median plane. Alternatively the blades consist of flat or angled surfaces.

Preferably the position of the buoyant center of gravity can be varied by incorporating buoyant or semibuoyant materials with in the shank or by removing material from shank to define holes therealong. Alternatively the buoyant center of gravity can be varied using material of different density. Conveniently this is achieved by disposing a heavy metal such as lead beneath the join of said blades.

Conveniently the shape of the flukes is such that when a pull is applied to the leading end of the shank when said anchor is lying on the seabed the apex penetrates the seafloor and the apex acts as a fulcrum on further pulling so that the fluke is self-burying. The anchor rotates upright with the shank upper most because of the large surface areas presented by the transverse portions of the blades as the pull is exerted at said leading end.

Preferably the anchor is a one-piece casting. Alternatively the anchor can be formed by welding the shank to the fluke to form a single unit.

Preferably also the shank incorporates a resilient portion therein to minimise deformation to the shank if a pull is effected on the shank transverse to the usual line of action.

Conveniently a support member is coupled between the trailing ends of the blades, said support being connected between the underside surfaces at the trailing end of the blades.

Preferably also the shank includes connection means disposed on said shank for the securing of a pennant or trip cable.

In accordance with a further aspect of the present invention there is provided a burying type anchor, comprising a shank, and rigidly connected thereto, a fluke in the general form of a double bladed plough-share with a pointed forward end and substantially symmetrical about a longitudinal median plane, the generally inwardly dished outer surface of each blade of the fluke extending either side of a central ridge formed by the junction between said outer surfaces, and being generally parallel to said central ridge at the forward end portion of the fluke and diverging in the direction towards a rear end portion of the fluke at which said fluke is connected to the shank so that said fluke blade surface extends substantially obliquely with respect to said central ridge at said rear portion at least in an outer side portion laterally spaced from the central ridge so that the fluke presents a substantial surface area facing generally in the direction of the pull on the anchor in use thereof when said anchor has penetrated the mooring bed and orientated itself with respect to the direction of the pull, said shank and fluke being arranged to define a buoyant center of gravity disposed between the shank and the fluke forwardly of the join of the shank and the fluke.

With an anchor of the present invention the desirable characteristics of rapid rolling into the upright attitude from any attitude which the anchor may settle on the mooring bed with quick penetration of the pointed end of the fluke as the anchor is dragged, are retained and even improved to some extent as will be further explained hereinbelow. In addition though, the anchor exhibits substantial resistance to "roll out" upon continued dragging and is able to maintain a relatively high anchoring force even when subjected to such dragging over an extended distance.

Whilst various shapes of outer fluke blade surfaces may be used within the scope of the present invention as defined herein, advantageously there is used a section of a generally conical or pyramidal or hexagonal surface generated from a point at the leading end of the shank, the eyelet, and the single apex and the outer trailing edges of blades lie on the surface of the cone.

An embodiment of the present invention will now be described, by way of example, in which.

Figure 1:
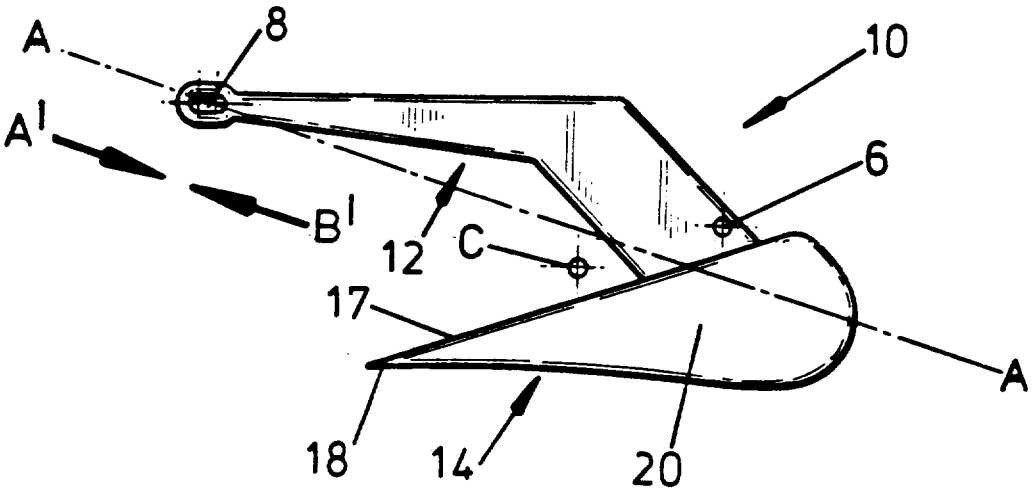
FIG. 1 is a side elevation of an embodiment of an anchor of the present invention.
Figure 2:
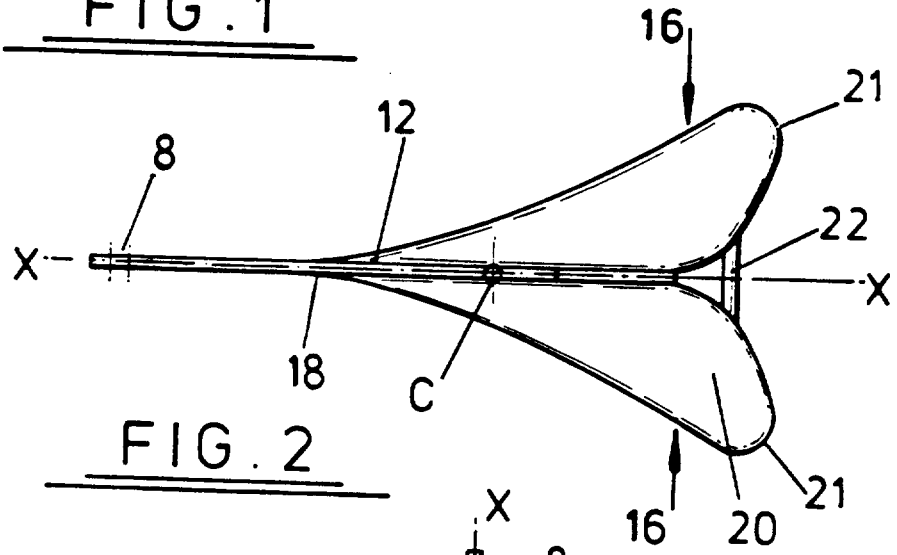
FIG. 2 is a plan view of the anchor in FIG. 1.
Figure 3:
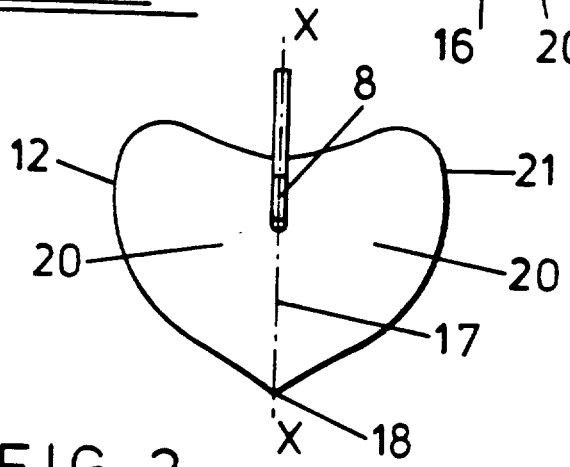
Figure 4:
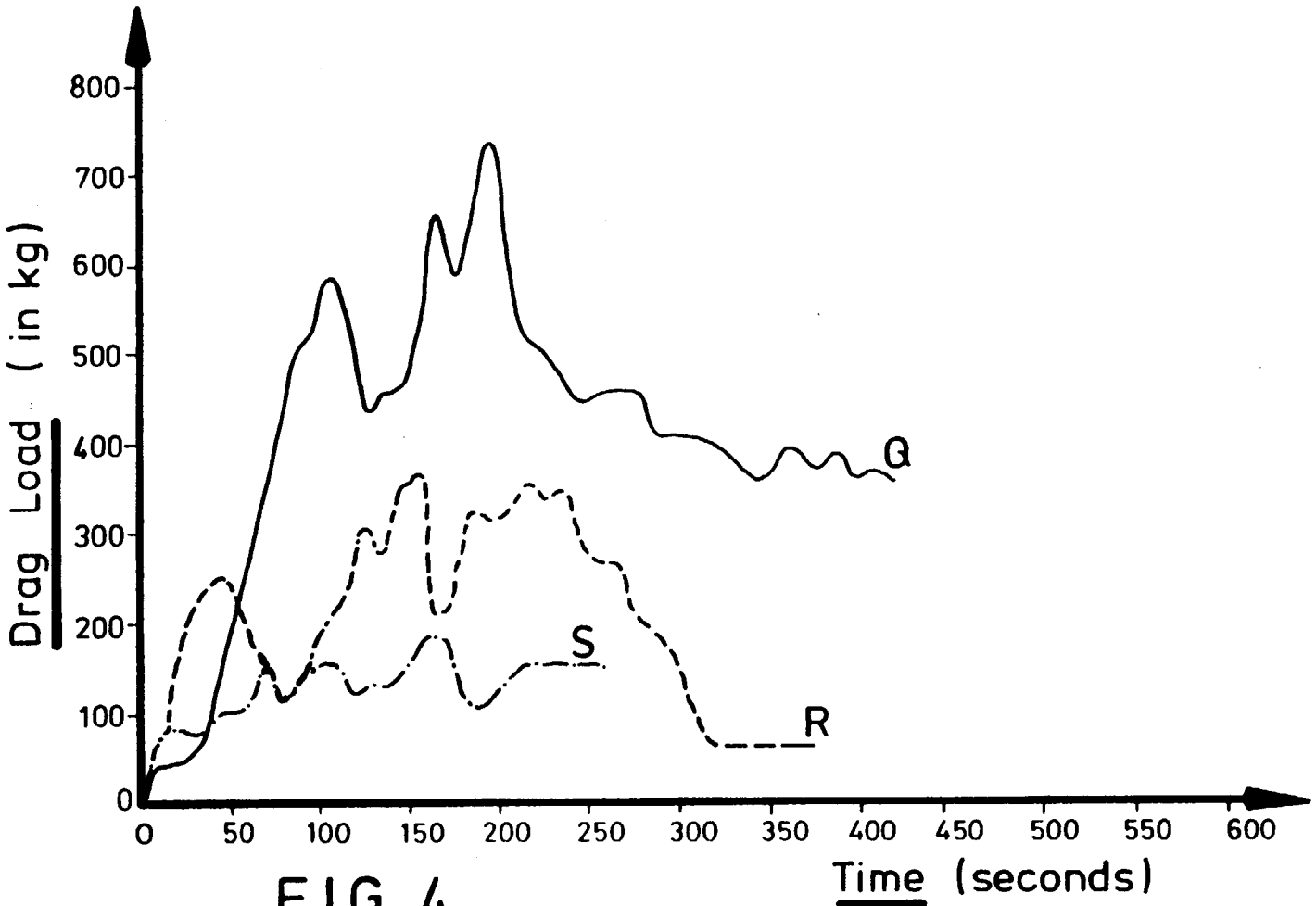
Figures 5A, 5B:
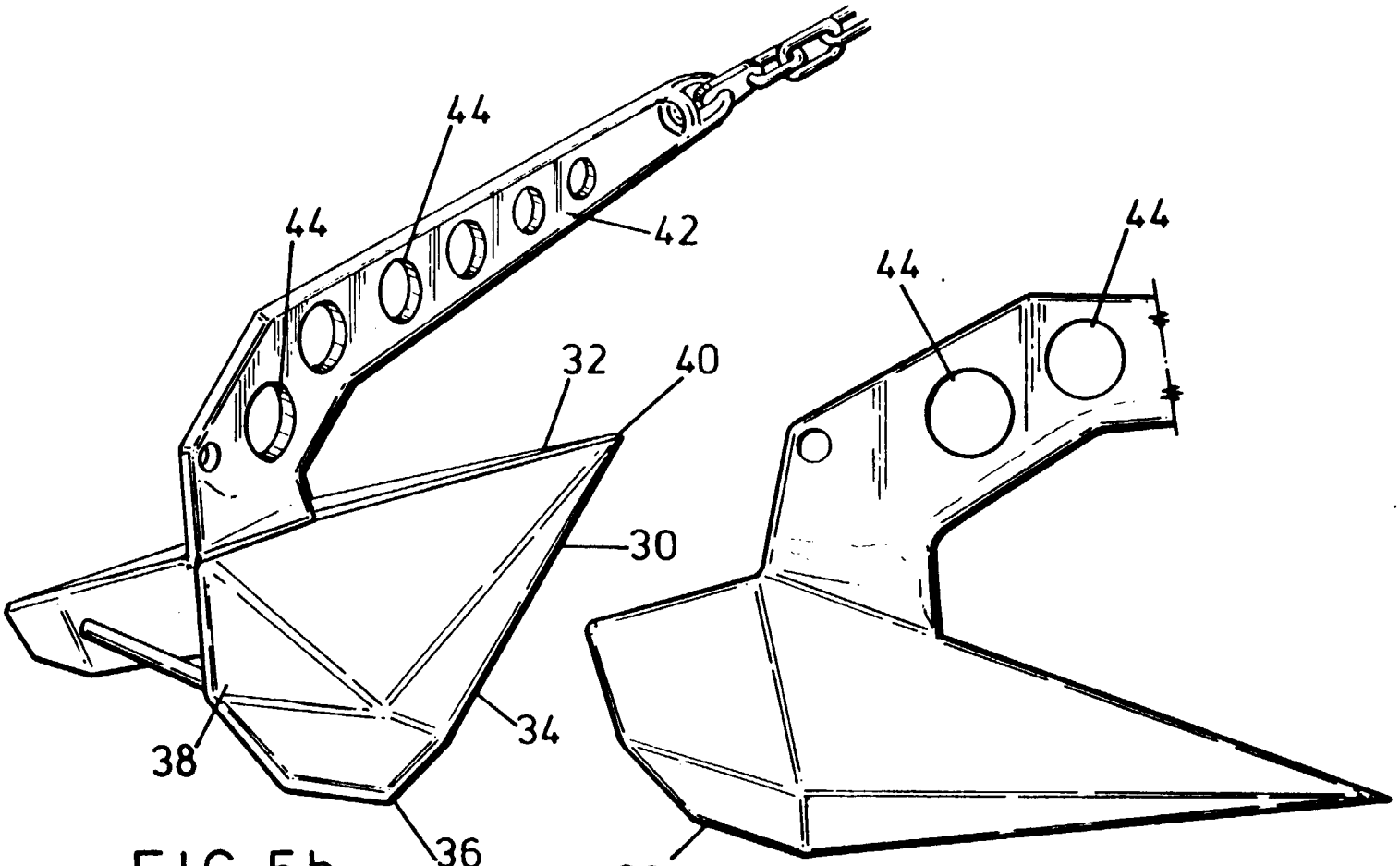

FIG. 3 is an elevational view of the anchor of FIG. 1 as seen looking in direction Al along the line $AA^1$ in FIG. 1, and FIG. 4 is a graph comparing the performance figures of the anchor of FIG. 1 with two known burying-type anchors, and FIGS. 5*a*, 5*b*; 6*a*, 6*b* and 7*a*, 7*b* depict front and rear perspective views of alternative embodiments of anchors according to the present invention with each alternative embodiment having flat plates FIGS. 1 and 2 show one piece cast anchor 10 comprising a rigid elongated shank 12 connected to a fluke 14. The shank 12 is provided with an aperture means 6 for securing a pennant or trip cable (not shown) The shank 12 is additionally provided with connection means in the form of an elongated aperture or eyelet 8 for securing the main anchor cable. It will be appreciated that any form of anchor cable may be used including chain and steel or natural or synthetic fiber rope or hauser.

The fluke 14 is in the form of a double bladed ploughshare having two curved blades 16 as best shown in FIG. 2, which are symmetrically coupled about ridge 17 along median plane X—X. As best depicted in FIGS. 1 and 3, the blades 16 have a single apex defined by the pointed forward end 18 of the ploughshare With further reference to FIGS. 2 and 3 each blade 16 has, when viewed from above, a concave outer surface 20 extending rearwardly and outwardly from the shank 12 and plane X—X. The concave outer surface 20 Of each blade 16 presents a substantial surface area best seen in FIG. 3, extending transversely outwards with respect to the direction B1, along which the drag force is applied Each blade terminates in a trailing edge 21, the underside convex surfaces of which are connected by a strut 22 to resist compressive forces acting on the blades 20 during drag.

Again referring to FIG. 1, a buoyant center of gravity C s defined between the fluke 14 and shank 12 as shown When the anchor is dropped to the seabed the buoyant center of gravity C causes the anchor 10 to land on the seabed and have three points of contact with the seabed which are: the eyelet 8 at the leading end of the shank 12, the single apex 18 of the plough, and one of the tails of either blade 16 so that the anchor will lie on its side on the seabed.

Once on the seabed, in the 3-point contact position, a drag force is applied in direction $B^1$. The surfaces 20 in contact with the seabed in combination with apex 18 reacts such that downward forces are created on the anchor and the apex 18 of the plough penetrates the seabed. The cross-section of the fluke 14 in proximity to the apex 18 is V-shaped and acts as a fulcrum and the surfaces 20 cause the anchor to rotate upright when pulled and the fulcrum provide by the apex 20, together with the line of action along $B^1$ results in the anchor becoming self-burying.

As a continuing load is applied to the anchor, it moves in the general direction of the load creating a drag resistance. If the drag is uniform or increasing the anchor remains in the seabed securing the vessel. The shape of the blades 20 causes the anchor to remain upright, and self-alinged in the direction of pull. If the anchor encounters an obstruction the shape of the blades 16 causes the anchor to self-steer around the projection in the direction of pull. For example, if a stone obstructs the movement of the anchor 10 of a point on one of the blades 16 then the obstructed blade will "dig in" to the seabed, causing the other blade to work clear of the seabed and present an increase in the projected bladed area on the side opposite the obstruction. This together with the decrease in the projected blade area at the obstruction permits the anchor to bypass the obstruction. Once the anchor has passed the obstruction a higher degree force acting on the increased area caused the anchor to revert to its original stable attitude.

When the vessel wishes to recover the anchor, the anchor chain is shortened until the vessel is positioned directly above the buried anchor. Further vertical pull on the line causes the anchor to rotate out of the seabed into an upwards direction such that the 'V' shaped fluke orientation and apex 18 are generally vertical and this minimises resistance to lifting the anchor out of the seabed.

As shown in the drawings the shank is conveniently in the form of a plate member and this requires minimal machining in its manufacture The fluke is conveniently in the form of two sheet metal plates bent to the required dished, irregular conic, form and welded together along the central ridge.

As has already been noted that anchor of the invention has significantly improved performance in a number of respects. FIG. 4 compares the performance of an anchor of the invention (Q) with two previously known burying anchors according to UK Patent No. 415176 (R) and UK Patent No. 1356259 (S), all of approximately similar weight in the region of 10 kg. In the graph drag load in (in kg) is plotted against time (in seconds) corresponding to the duration of continued dragging to which the anchor is subjected. As may be seen in the graph anchor S develops only a limited resistance to dragging in the region of 150 kg. Anchor R develops substantially higher anchoring forces corresponding to resistance to dragging of up to approximately 350 kg. Eventually, however,.this anchor 'rolls out' and as it emerges from the mooring bed the anchoring force falls away rapidly In contrast to the known anchors, the anchor shown in the drawings (Q) develops a very much higher maximum resistance of over 700 kg. and even after prolonged dragging a very high dragging resistance of nearly 400 kg. is maintained.

Reference is now made to FIGS. 5*a* and 5*b* of the drawings which depicts an alternative modification of a marine anchor in accordance with the present invention. In this embodiment it will be seen that the blades 30 are not curved but consist of 4 flat sections which are interconnected as shown. The blades taper towards a single apex 40 in the same way as before and each blade 30 is also dished inwardly (concave) as with the curved blade shown in FIGS. 1 to 3. The shank 42 has a plurality of circular holes 44 machined therein so that the buoyant center of gravity can be predetermined.

Figures 6A, 6B:
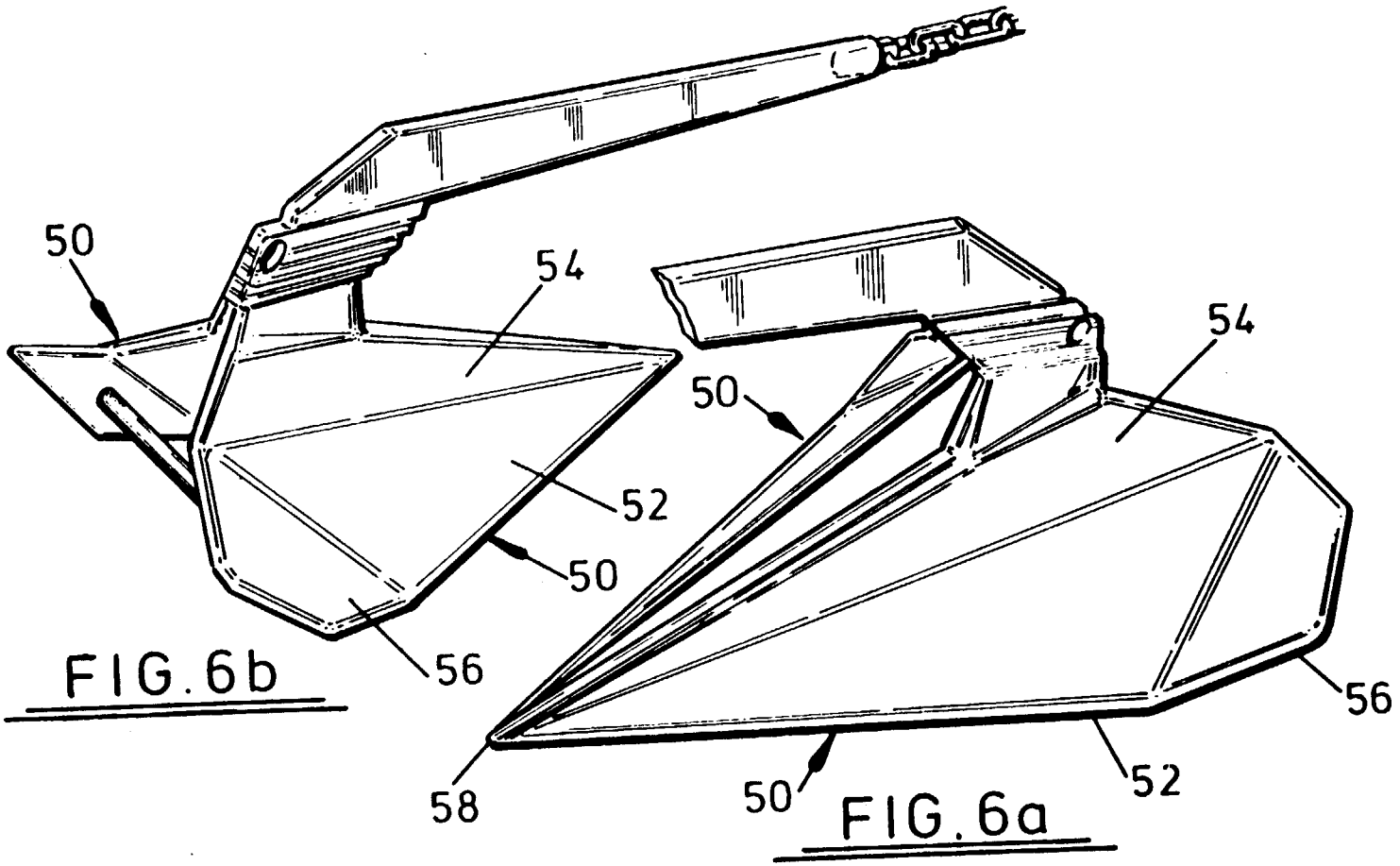

Reference is now made to FIGS. 6*a* and 6*b* which shows an anchor similar to that shown in FIGS. 5*a* and 5*b* except that each blade of the anchor 50 is formed by 3 plate 52, 54, and 56 interconnected. The plates taper towards a single apex 58 and are dished inwardly as before.

Figures 7A, 7B:
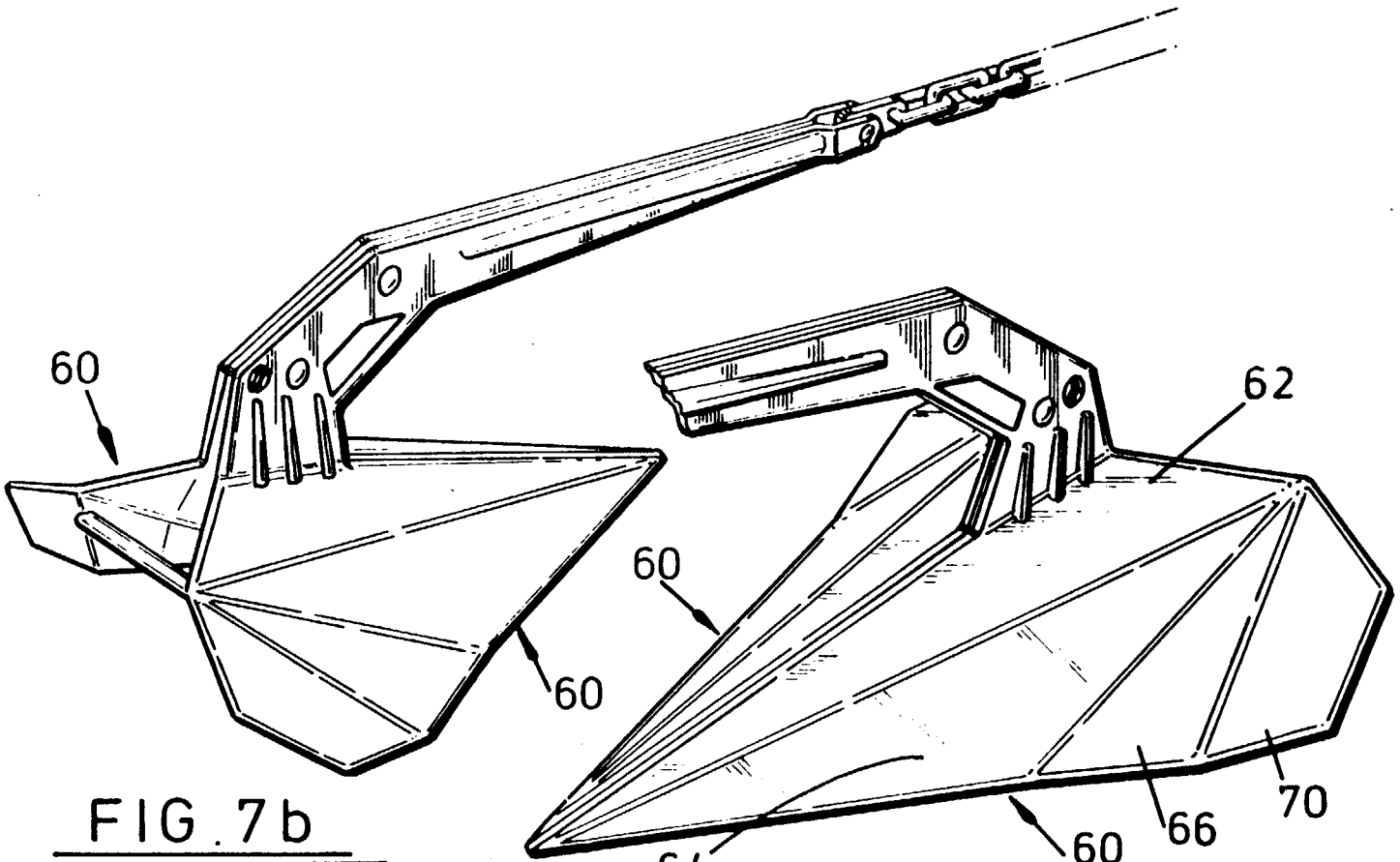

Referring now to FIGS. 7*a* to 7*b* this shows yet another modification of the marine anchor which has blades 60 made of 4 flat plates interconnected but which are shaped differently to those shown in FIGS. 5*a* and 5*b* and in in FIGS. 6*a* and 6*b*. Each blade 60 consists of 4 flat blades 62, 64 66 and 70 which are interconnected as shown which taper to a common apex 72 and each blade 60 is dished inwardly or concave shaped as indicated above.

A number of modifications can be made to the embodiment described without departing from the scope of the invention. For example, the buoyant center of gravity can be varied, although it is desirable to keep the center of gravity below the line of pull action A—A in FIG. 1, by the addition of weights, provided by heavy metals such as lead, disposed beneath the ridge joining the blades of the fluke or by the incorporation of buoyant or semibuoyant materials such as air or foam in the shank. The strut may be omitted if the blades 20 are sufficiently rigid The blades may be flat or angled as well as curved to define a concave appearance and the anchor may be made by welding the shank 12 to the fluke 14 instead of casting. The anchor can be modified to include spring or resilient materials on the shank to prevent permanent deformation to the shank if the direction of pull is changed and also so that the anchor will re-orientate in the new direction of pull without emerging from the seabed.

An advantage of the embodiments hereinbefore described are that the anchor always lands on the seabed in 3-point contact, so that in response to a pull its after surface causes the rear end of the anchor to rise up causing the apex to penetrate the seabed. Other advantages are that the sharp single apex can penetrate a variety of seabed surfaces including weed, sea grass, kelp in sand as well as shingle. The single point and blade shape facilitate the tip acting as a fulcrum in response to line pull and causes the anchor to become effectively embedded in the seabed. The anchor is self-aligning in the direction of pull and roll-stable when being dragged along the seabed. The shape of the fluke blades are that on meeting an obstruction the blade area increases in the side opposite to the obstruction and causes the anchor to self steer around the obstruction in the direction of pull.

Furthermore the anchor stows in the bow roller so that tension on the pull end of the shank locks the anchor from movement in a seaway with the center of gravity inboard and release of tension causes the anchor to slide forward on the bow roller such that the center of gravity is moved outboard of the bow roller in which case the anchor rotates about the stemhead roller and self-launches The unitary construction, cast or fabricated, facilitates safer handling because of the absence of a hinge The shape of the anchor is such that should it bury in a soft seabed with the tail down and point up, pulling on the anchor causes the tail, which is at an angle greater that 65° to the direction of pull, to lift up and cause the apex and tip to penetrate the seabed.

We claim:

1. An anchor of the type buried in the seabed by a pull in a longitudinal direction, comprising a substantially rigid shank, and rigidly connected thereto, a fluke in the form of a double bladed plough-share with a pointed forward end and a central ridge and substantially symmetrical about a longitudinal median plane, each blade of the fluke having a generally inwardly dished outer surface extending to either side of the central ridge, formed between said outer surfaces, and being generally parallel to said central ridge at the forward end portion of the fluke and diverging in the direction towards a rear end portion of the fluke at which said fluke is connected to the shank so that said fluke blade surface extends substantially obliquely with respect to said central ridge at said rear portion at least in an outer side portion laterally spaced from the central ridge so that the fluke presents a substantial surface area facing generally in the direction of pull on the anchor in use thereof when said anchor has penetrated the mooring bed and oriented itself with respect to the direction of pull, said shank and fluke being arranged to define a buoyant center of gravity disposed between the shank and the fluke forwardly of the connection between the shank and the fluke.

2. A one-piece anchor for casting from a vessel and securing on the seabed comprising:

a substantially rigid shank have leading end for connection to a main anchor cable; and a fluke rigidly fixed to the shank and generally in the form of a double bladed plough-share with the blades disposed symmetrically about a median plane of the shank and having leading and trailing ends, the leading ends of the blades terminating in a single apex, the trailing ends of each blade diverging outwardly from said median plane, and each blade having a generally inwardly dished shape, said shank and fluke arranged to define a buoyant center of gravity disposed between the shank and the fluke forwardly of the fixed connection between the shank and the fluke to influence the attitude of the sinking anchor and to effect landing of the anchor on the seabed with a three point contact provided by the leading end of the shank, the apex of the blades and the trailing end of one of the blades.

3. An anchor as claimed in claim 2 wherein said buoyant center of gravity is disposed on the fluke side of a line drawn between the leading end of the shank and a line of maximum blade width.

4. An anchor as claimed in claim 2 wherein the blades are curved metal sheets.

5. An anchor as claimed in claim 2 wherein the blades consist of a plurality of flat surfaces.

6. An anchor as claimed in claim 2 wherein the position of the buoyant center of gravity is varied by incorporating buoyant or semibuoyant materials within the shank.

7. An anchor as claimed in claim 2 wherein the position of the buoyant center of gravity is determined by disposing a heavy metal between the blades.

8. An anchor as claimed in claim 2 wherein the shape of the flukes is such that when a pull is applied to the leading end of the shank when said anchor is lying on the seabed the apex penetrates the seafloor and the apex acts as a fulcrum on further pulling so that the fluke is self-burying.

9. An anchor as claimed in claim 1 wherein the anchor is a one-piece casting.

10. An anchor as claimed in claim 2 wherein the anchor is formed by welding the shank to the fluke to form a single unit.

11. An anchor as claimed in claim 2 wherein the shank incorporates a resilient portion therein to minimise deformation to the shank if a pull is effected on the shank transverse to the usual line of action which lies substantially parallel to the median plane of the shank.

12. An anchor as claimed in claim 2 wherein a support member is coupled between the trailing ends of the blades, said support being connected between underside surfaces of the blades at the trailing end of the blades.

13. An anchor as claimed in claim 2 wherein the shank includes connection means disposed on said shank for the securing of a pennant or trip cable.

14. An anchor as claimed in claim 2 wherein the blades consist of a plurality of angled surfaces.

15. An anchor as claimed in claim 2 wherein the position of the buoyant center of gravity is varied by removing material from the shank to define holes therealong.

* * * * *

US005138967B1

REEXAMINATION CERTIFICATE (3106th)

United States Patent [19] [11] B1 5,138,967

McCarron et al. [45] Certificate Issued Jan. 14, 1997

[54] MARINE ANCHOR

[75] Inventors: Philip F. McCarron; James W. Stewart; Gordon M. Lyall, all of Glasgow, Scotland

[73] Assignee: Simpson-Lawrence Ltd., Glasgow, Scotland

Reexamination Request:
No. 90/004,045, Dec. 12, 1995

Reexamination Certificate for:

| | |
|---|---|
| Patent No.: | **5,138,967** |
| Issued: | **Aug. 18, 1992** |
| Appl. No.: | **582,939** |
| Filed: | **Apr. 3, 1989** |

[22] PCT Filed: Apr. 3, 1989

[86] PCT No.: PCT/GB89/00339

§ 371 Date: Nov. 1, 1990

§ 102(e) Date: Nov. 1, 1990

[87] PCT Pub. No.: WO89/09722

PCT Pub. Date: Oct. 19, 1989

[30] Foreign Application Priority Data

Apr. 9, 1988 [GB] United Kingdom ..... 8808373

[51] Int. Cl.[6] ..... B63B 21/32

[52] U.S. Cl. ..... 114/301

[58] Field of Search ..... 114/293, 294, 114/297, 298, 299, 300, 301, 302, 303, 304

[56] References Cited

U.S. PATENT DOCUMENTS

| | | | |
|---|---|---|---|
| 1,983,481 | 12/1934 | Mortensen | 114/301 |
| 2,161,906 | 6/1939 | Filby | 114/301 |
| 2,948,249 | 8/1960 | Gesner et al. | 114/298 |
| 3,040,692 | 6/1962 | Hardy, Jr. . | |
| 3,749,044 | 7/1973 | Klaren | 114/207 |
| 3,759,212 | 9/1973 | Cluett | 114/309 |
| 3,766,877 | 10/1973 | Beck | 114/208 |
| 4,173,938 | 11/1979 | Colin . | |
| 4,602,588 | 7/1986 | MacLean | 114/301 |
| 4,676,184 | 6/1987 | Ogg . | |

FOREIGN PATENT DOCUMENTS

| | | | |
|---|---|---|---|
| A1-61164/80 | 2/1982 | Australia . | |
| 225678 | 8/1985 | Germany | 114/301 |
| 3639023A1 | 6/1987 | Germany . | |
| 58-177789 | 10/1983 | Japan . | |
| 1910615 | 9/1969 | Netherlands . | |
| 7710882 | 4/1978 | Netherlands . | |
| 415176 | 8/1934 | United Kingdom . | |
| 574326 | 1/1946 | United Kingdom . | |
| 618897 | 3/1949 | United Kingdom . | |
| 1316946 | 5/1973 | United Kingdom . | |
| 1356259 | 6/1974 | United Kingdom . | |
| 1390790 | 4/1975 | United Kingdom . | |
| 1393431 | 5/1975 | United Kingdom . | |
| 1513453 | 6/1978 | United Kingdom . | |
| 2035242 | 6/1980 | United Kingdom . | |
| 1590085 | 5/1981 | United Kingdom . | |
| 2171970 | 9/1986 | United Kingdom . | |

OTHER PUBLICATIONS

H. L. Dove and G. S. Ferris, "Development of Anchors" pp. 535–538.

B. R. Clayton and R. E. D. Bishop, *Mechanics of Marine Vehicles*, pp. 60–63 and 77–78.

Excerpts from *The Complete Book of Anchoring and Mooring* by Earl R. Hinz, Cornell Maritime Press, Inc., Copyright 1986, pp. 170, 171, 173, 174, 175 and 176.

*Primary Examiner*—Stephen P. Avila

[57] ABSTRACT

A marine anchor is described which has a shank having a leading end for attachment to a cable and a general double-bladed ploughshare shaped fluke fixed to the shank with the blades disposed symmetrically about the median plane of the shank. The leading ends of the blades terminate in a single apex and the trailing ends of each blade diverges outwardly from said medial plane, each blade having a generally inwardly dished shape. The blades can be curved or consist of at least two flat angled surfaces.

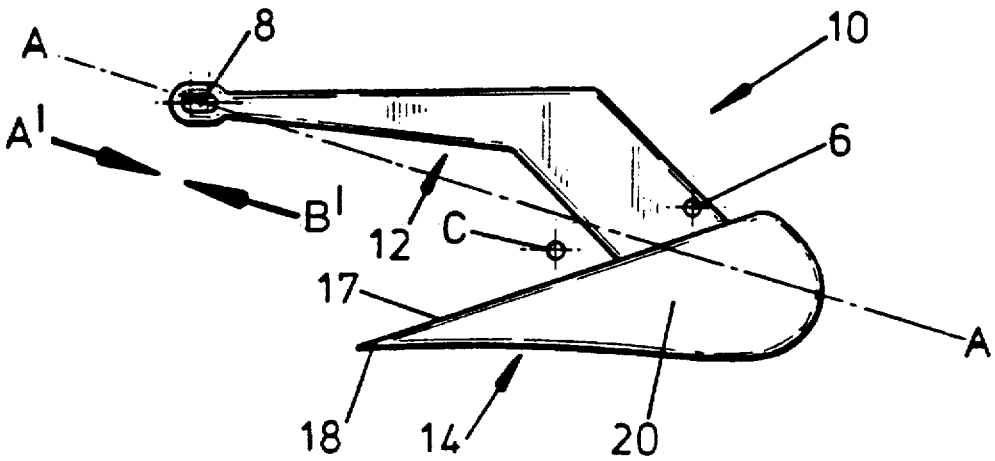

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–8 and 10–15 is confirmed.

Claim 1 is determined to be patentable as amended.

Claim 9, dependent on an amended claim, is determined to be patentable.

New claims 16–30 are added and determined to be patentable.

1. An anchor of the type *cast from a vessel and* buried in the seabed by a pull in a longitudinal direction, comprising a substantially rigid shank, and rigidly connected thereto, a fluke in the form of a double bladed plough-share with a pointed forward end and a central ridge and substantially symmetrical about a longitudinal median plane, each blade of the fluke having a generally inwardly dished outer surface extending to either side of the central ridge, formed between said outer surfaces, and being generally parallel to said central ridge at the forward end portion of the fluke and diverging in the direction towards a rear end portion of the fluke at which said fluke is connected to the shank so that said fluke blade surface extends substantially obliquely with respect to said central ridge at said rear portion at least in an outer side portion laterally spaced from the central ridge so that the fluke presents a substantial surface area facing generally in the direction of pull on the anchor in use thereof when said anchor has penetrated the mooring bed and oriented itself with respect to the direction of pull, said shank and fluke being arranged to define a buoyant center of gravity disposed between the shank and the fluke forwardly of the connection between the shank and the fluke.

*16. An anchor of the type cast from a vessel and buried in the seabed by a pull in a longitudinal direction, comprising:*

*a substantially rigid shank with a leading end; and*

*a fluke rigidly connected to the shank opposite the shank leading end to define a buoyant center of gravity disposed between the shank and the fluke forward of the connection between the shank and the fluke, wherein said fluke is in the form of a double bladed plough-share, substantially symmetrical about a longitudinal median plane, with a pointed forward end and a central ridge,*

*each blade of the fluke has a generally inwardly dished outer surface extending to either side of the central ridge, said dished surfaces terminating in a concave leading edge opposite the central ridge and a trailing edge opposite the pointed forward end, and*

*the outer surfaces are generally parallel to said central ridge at the forward end portion of the fluke and diverging in a direction towards a rear end portion of the fluke at which said fluke is connected to the shank so that said fluke blade surface extends substantially obliquely with respect to said central ridge at said rear portion at least in an outer side portion laterally spaced from the central ridge so that the fluke presents a substantial surface area facing generally in the direction of pull on the anchor in use thereof when said anchor has penetrated the mooring bed and oriented itself with respect to the direction of pull.*

*17. The anchor according to claim 16 wherein the concave leading edge of each blade comprises a smooth curve.*

*18. The anchor according to claim 16, wherein the concave leading edge of each blade comprises at least two straight line segments.*

*19. The anchor according to claim 16, wherein the anchor has a line of pull defined by a line drawn between the leading end of the shank and a point on the blade trailing edge corresponding to the maximum width of the fluke, and the buoyant center of gravity is disposed on the fluke side of the line of pull.*

*20. The anchor according to claim 16, wherein the shank and the fluke are shaped and arranged such that the anchor will lie on its side on the seabed and penetrate from a position of three points of contact with the seabed, said three points being the leading end of the shank, the pointed forward end of the fluke and the trailing edge of one of the blades.*

*21. A one-piece anchor for casting from a vessel and burying in the seabed by a pull in the longitudinal direction, comprising:*

*a substantially rigid shank having leading end for connection to a main anchor cable; and*

*a fluke rigidly fixed to the shank opposite the shank leading end and in the form of a double bladed plough-share with a pointed forward end and a central ridge, said blades being disposed substantially symmetrically about a longitudinal median plane to define a buoyant center of gravity disposed between the shank and the fluke forward of the fixed connection between the shank and the fluke;*

*said blades having leading and trailing end portions with a leading edge defined therebetween, the leading end portions of the blades terminating in a single fluke apex, the trailing end portions of each blade diverging outwardly from said median plane to provide each blade with a generally inwardly dished outer surface extending to either side of the central ridge with each leading edge also generally curved inwardly such that a midportion of the leading edge is spaced inwardly from a line drawn between the forward end portion and the trailing end portion of the blade,*

*wherein said outer surfaces are generally parallel to the central ridge at the leading end portion of the fluke and diverge in a direction towards the trailing end portion of the fluke so that said fluke blade surface extends substantially obliquely with respect to the central ridge at the trailing edge portion at least in an outer side portion laterally spaced from the central ridge so that the fluke presents a substantial surface area facing generally in a direction of pull on the anchor in use thereof once an anchor has penetrated the seabed, and*

*said fluke and shank being arranged such that the anchor has three points of contact with the seabed after landing thereon, said three points provided by the leading end of the shank, the apex of the blades and the trailing end portion of one of the blades.*

*22. The anchor as claimed in claim 21 wherein said buoyant center of gravity is disposed on the fluke side of a line drawn between the leading end of the shank and the line of maximum blade width.*

*23. The anchor as claimed in claim 21 wherein the blades are curved metal sheets.*

*24. The anchor as claimed in claim 21 wherein the blades comprise a plurality of flat surfaces.*

*25. The anchor as claimed in claim 21 wherein the position of the byoyant center of gravity is determined by disposing a heavy metal between the blades.*

*26. A one-piece anchor for casting from a vessel and burying in the seabed by pull in a longitudinal direction, comprising:*

*a substantially rigid shank having a leading end for connection to a main anchor cable; and*

*a double bladed plough-share fluke rigidly fixed to the shank at a rear end portion of the fluke, wherein the blades extend outward from a central ridge and are generally parallel to said central ridge at a forward end portion of the fluke and diverge in a direction towards the rear end portion of the fluke, the blades being disposed substantially symmetrically about a longitudinal median plane, with a weight disposed beneath the central ridge to define a buoyant center of gravity disposed between the shank and the fluke forward of the fixed connection between the shank and the fluke, wherein*

*each blade of the fluke has a generally inwardly dished outer surface on either side of the central ridge, said dished surfaces terminating in a concave leading edge such that the leading edge of each blade joins the central ridge to form a point at the forward end portion,*

*the outer surfaces of the blades diverge outward in a direction opposite the pointed forward end such that said fluke blade surfaces extend substantially obliquely with respect to said central ridge in the rear end portion of each blade at least in an outer side portion of each blade laterally spaced from the central ridge to present a substantial surface area facing generally in the direction of pull on the anchor in use thereof when said anchor has penetrated the seabed and oriented itself with respect to the direction of pull, and*

*said fluke and shank are arranged such that the anchor when pulled penetrates from a position of three points of contact with the seabed, said three points provided by the leading end of the shank, the pointed forward end of the blades and the rear end portion of one of the blades.*

*27. The anchor according to claim 26 wherein the concave leading edge of each blade comprises a smooth curve.*

*28. The anchor according to claim 27 wherein the blades are curved metal sheets.*

*29. The anchor according to claim 26, wherein the concave leading edge of each blade comprises at least two straight line segments.*

*30. The anchor according to claim 29 wherein the blades comprise a plurality of flat surfaces.*

* * * * *